US008613435B2

(12) United States Patent
Kato et al.

(10) Patent No.: US 8,613,435 B2
(45) Date of Patent: Dec. 24, 2013

(54) SHEET PROCESSING APPARATUS

(75) Inventors: Hitoshi Kato, Toride (JP); Naoki Ishikawa, Kashiwa (JP); Yasuo Fukatsu, Abiko (JP); Tomoharu Sato, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/417,584

(22) Filed: Mar. 12, 2012

(65) Prior Publication Data

US 2012/0243962 A1 Sep. 27, 2012

(30) Foreign Application Priority Data

Mar. 25, 2011 (JP) ..... 2011-068004

(51) Int. Cl.
*B31F 1/10* (2006.01)

(52) U.S. Cl.
USPC ..... 270/45; 270/32; 270/58.07

(58) Field of Classification Search
USPC ..... 270/32, 45, 51, 58.07; 493/406, 407, 493/442, 454
See application file for complete search history.

(56) References Cited

U.S. PATENT DOCUMENTS

| | | | | |
|---|---|---|---|---|
| 2,066,620 | A * | 1/1937 | Grammer | 281/27.3 |
| 7,147,598 | B2 * | 12/2006 | Fujimoto et al. | 493/405 |
| 7,285,084 | B2 * | 10/2007 | Fujimoto et al. | 493/442 |
| 7,431,274 | B2 * | 10/2008 | Kushida et al. | 270/37 |
| 7,673,862 | B2 * | 3/2010 | Kushida et al. | 270/32 |
| 7,802,779 | B2 | 9/2010 | Kamiya | |
| 2011/0081183 | A1 * | 4/2011 | Watanabe et al. | 399/407 |
| 2011/0176892 | A1 * | 7/2011 | Urano | 412/25 |
| 2011/0278782 | A1 * | 11/2011 | Watanabe et al. | 270/1.01 |

* cited by examiner

*Primary Examiner* — Leslie A Nicholson, III
(74) *Attorney, Agent, or Firm* — Canon USA, Inc., IP Division

(57) ABSTRACT

A folding line is pressed using both a first and second pressing members of press roller pairs. Further, positions of the first and second pressing members are shifted from each other. When the number of the sheets included in a booklet is a predetermined number or less, the folding line is pressed by only the first pressing member. When the number of the sheets is more than the predetermined number, the folding line is pressed by both the first and second pressing members.

20 Claims, 11 Drawing Sheets

SHEET PROCESSING APPARATUS

BACKGROUND OF THE INVENTION

1. Field of the Invention

The present invention relates to a sheet post-processing apparatus performing post-processing on a folded portion of a bundle of sheets stacked and folded.

2. Description of Related Art

A conventional sheet post-processing apparatus performing post-processing on a sheet on which an image is formed performs saddle-stitch bookbinding, in which a sheet bundle acquired by collecting conveyed sheets is stitched in the vicinity of a center thereof in a conveyance direction for example, doubled at a stitched portion to make it in a booklet-like shape, and then discharged. In this case, the sheet post-processing apparatus thrusts the center portion of the sheet bundle with a thrust member after stitch processing is performed, and pushes the center portion thereof into a nip of a folding roller pair to fold the sheet bundle. Further, U.S. Pat. No. 7,802,779 discusses a sheet post-processing apparatus including a folding-line reinforcing mechanism for reinforcing a folding line of a booklet by moving a roller pair along the folding line while pressing the folding line. With such a configuration, quality, such as an appearance, of the bound sheet bundle can be enhanced.

The sheet post-processing apparatus discussed in the U.S. Pat. No. 7,802,779 may not be able to sufficiently reinforce the folding line only by pressing the folding line once with the roller pair, when the number of sheets forming the booklet is increased or the sheet having a large basis weight is used. Even in such a case, to realize sufficiently reinforcing the folding line, it is conceivable to intermittently move the roller pair, or to move them back and forth a plurality of times. However, such a method for moving the roller pair may take time to perform processing for reinforcing the folding line, thereby lowering productivity.

SUMMARY OF THE INVENTION

The present invention provides a sheet post-processing apparatus capable of reinforcing a folding line without lowering productivity.

According to an aspect of the present invention, a sheet post-processing apparatus includes: a folding unit configured to fold a sheet bundle including a plurality of sheets; and a fold reinforcing unit configured to reinforce fold by pressing a folding line of the sheet bundle folded by the folding unit, wherein the fold reinforcing unit comprises first and second pressing members moving along the folding line while pressing the folding line; and wherein the first pressing member moves while pressing the folding line after the second pressing member has moved while pressing the folding line.

DESCRIPTION OF THE EMBODIMENTS

Figure 1:
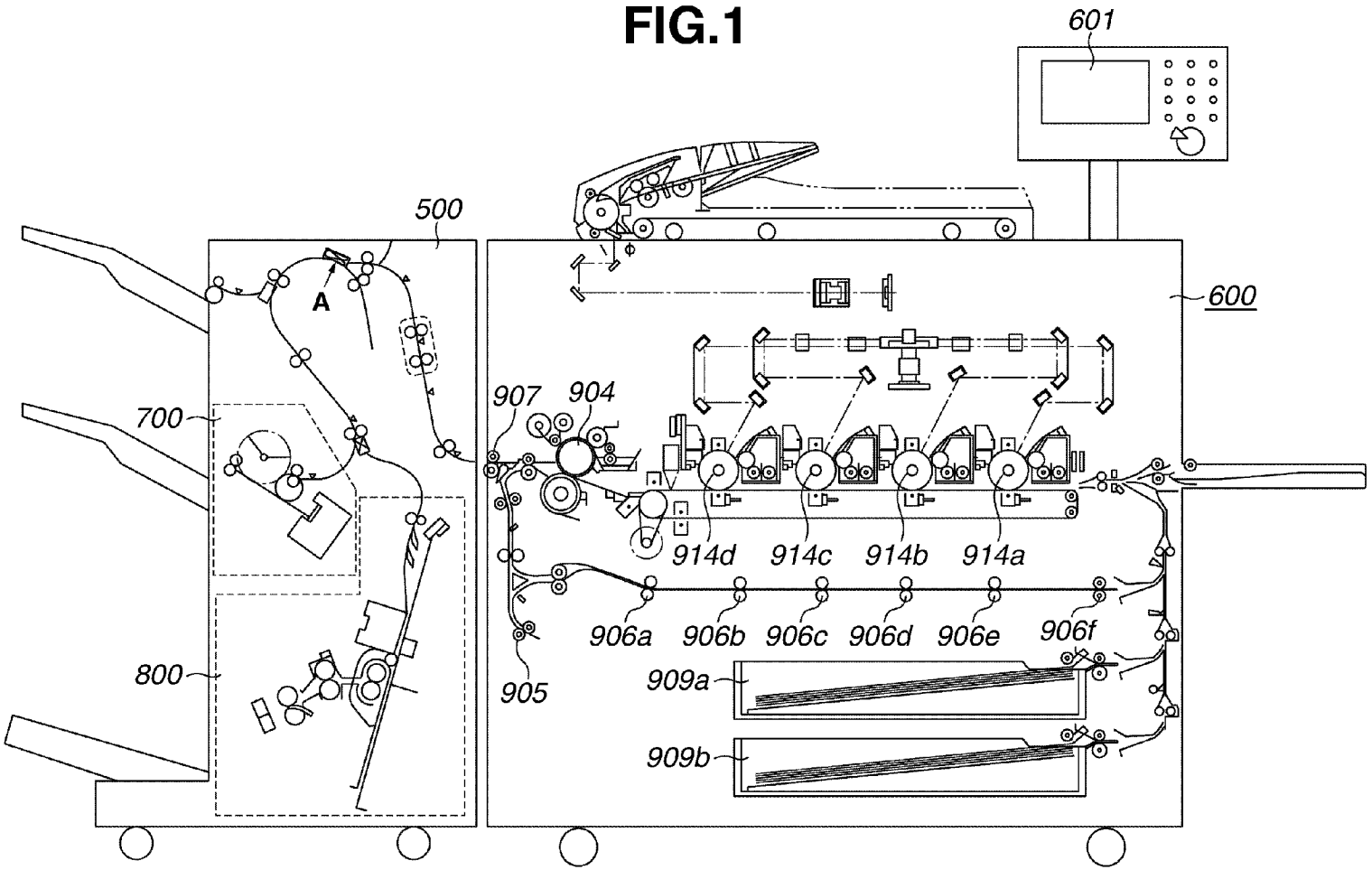
FIG. 1 is a schematic cross-sectional view of an image forming apparatus and a sheet processing apparatus.

A first exemplary embodiment will be described. First, an image forming apparatus will be described. FIG. 1 is a configuration diagram of an image forming system including an image forming apparatus and a sheet post-processing apparatus. As illustrated in FIG. 1, the image forming system includes an image forming apparatus 600 of an electrophotography type forming a monochrome/color image and a finisher 500 connected to a downstream side of the image forming apparatus 600 as a sheet post-processing apparatus. Therefore, a sheet discharged from the image forming apparatus 600 is conveyed into the finisher 500, where post-processing is performed on the sheet as necessary. The image forming apparatus 600 can be also used solely without connecting the finisher 500 to a discharge port. Further, the image forming apparatus 600 may integrally incorporate the finisher 500 as a sheet discharge device. The image forming apparatus 600 includes an operation unit 601 via which an operator performs various types of inputs and settings. A position where the operation unit 601 is viewed is referred to as a front near side (hereinafter, referred to as a front side) of the image forming apparatus, and a back side of the apparatus is referred to as a rear side thereof.

On the sheet "S" fed from cassettes 909*a*, 909*b* in the image forming apparatus 600, toner images of respective four colors are overlapped and transferred by image forming units 914*a* to 914*d* for yellow, magenta, cyan, and black. The image forming units 914*a* to 914*d* form the toner images by a known electrophotography method. The sheet "S" on which the toner images are transferred is conveyed to a fixing device 904 to fix the toner images. In a one-sided image forming mode, the sheet is directly discharged by a discharge roller pair 907 to the finisher 500. In a two-sided image forming mode, the sheet "S" is switch-back conveyed from a fixing device 904 by a reversing roller 905 to reverse the front and rear of the sheet "S", and then conveyed in a direction of the two-sided conveyance rollers 906*a* to 906*f*. Subsequently, the image is formed on the rear surface of the sheet "S" by the image forming units 914*a* to 914*d*. The toner images are fixed onto the sheet "S" by the fixing device 904, and then discharged out of the apparatus body by the discharge roller pair 907.

Figure 2:
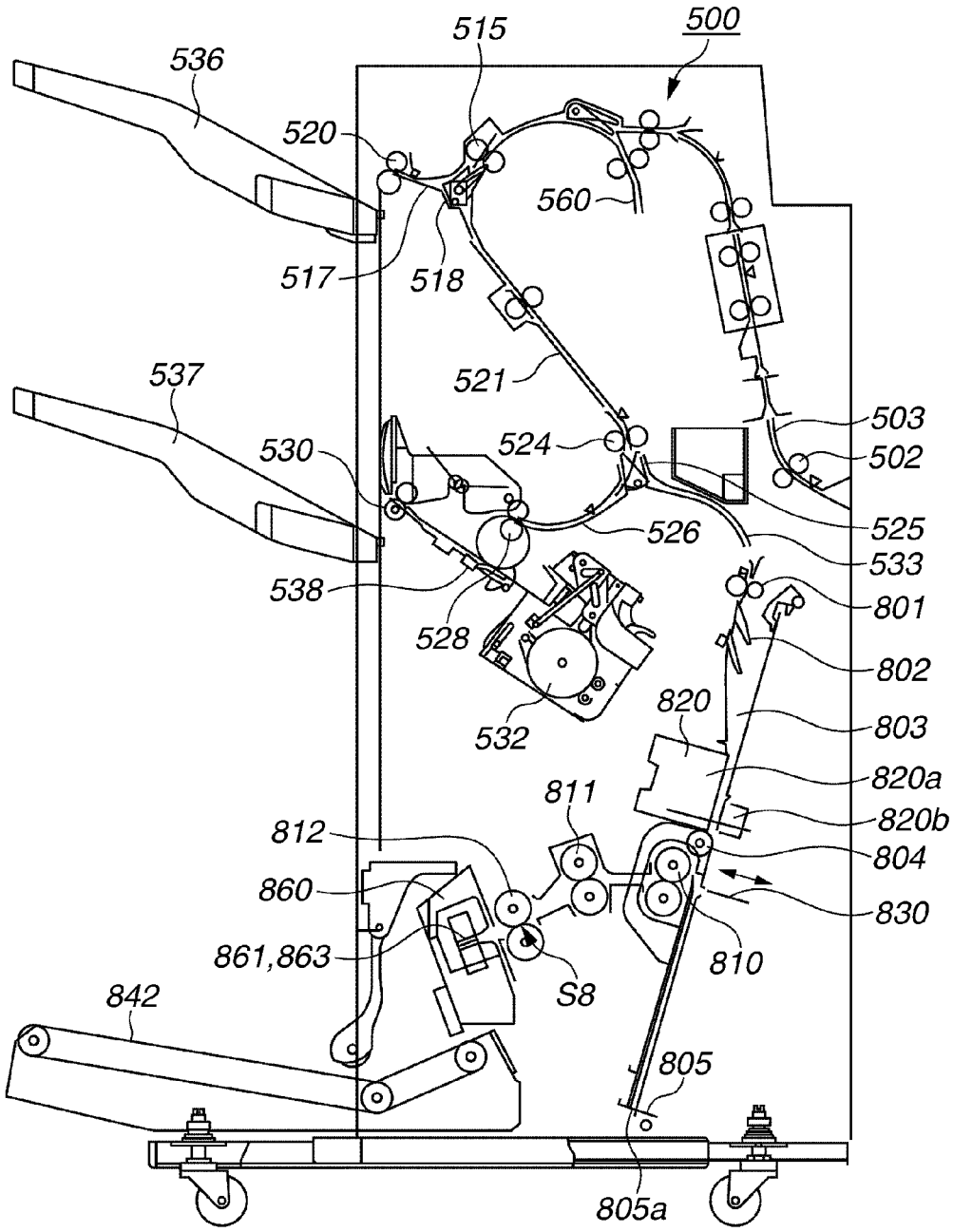
FIG. 2 is a cross-sectional view of the sheet processing apparatus.

The finisher will be described. FIG. 2 is a configuration diagram of the finisher 500 serving as the sheet post-processing apparatus. The sheet "S" discharged from the image forming apparatus 600 is transferred to an entrance roller pair 502 of the finisher 500. The sheet "S" conveyed by the entrance roller pair 502 is conveyed up to a conveyance roller pair 515 through a conveyance path 503. Thereafter, when the sheet "S" is discharged to an upper discharge tray 536, a flapper 518 switches a conveyance path to lead the sheet "S" to an upper path conveyance passage 517, and then the sheet "S" is discharged to the upper discharge tray 536 by an upper discharge roller pair 520.

When the sheet "S" is not discharged to the upper discharge tray 536, the flapper 518 switches the conveyance path to lead the sheet "S" to a conveyance path 521, and then the sheet "S" is conveyed up to a conveyance roller pair 524. When saddle processing is specified, a flapper 525 switches the conveyance path to convey the sheet "S" to a saddle path 533, and then the sheet "S" is led to a saddle-stitch binding unit 800 (refer to FIG. 1) by a saddle entrance roller pair 801 so that the saddle-stitch binding processing (saddle processing) is performed.

Further, when the sheet "S" is discharged to a lower discharge tray 537, the flapper 525 switches the conveyance path to convey the sheet "S" to a lower path 526. Subsequently, the sheet "S" is discharged by a conveyance roller pair 528 to a processing tray 538, where the saddle processing is performed by a stapler 532. The sheet "S" is then discharged to the lower discharge tray 537 by a discharge roller pair 530 serving as a bundle discharge unit.

Next, a configuration of the saddle-stitch binding unit 800 will be described. The sheet conveyed to the saddle-stitch binding unit 800 is transferred to a saddle entrance roller pair 801. Depending on a size of the sheet, a switching member 802 selects a carry-in entrance to convey the sheet into a storage guide 803 serving as a sheet stacking unit. The storage guide 803 tilts such that a downstream side in a sheet conveyance direction is lower than an upstream side therein. The sheet which is carried in is further conveyed by a conveyance roller 804.

The saddle entrance roller pair 801 and the conveyance roller 804 are driven by an entrance roller motor M1 (not illustrated), and a driving timing is controlled by a saddle entrance sensor S1 (not illustrated). The sheet conveyed to the storage guide 803 is further conveyed until an end portion of the sheet (downstream end in the conveyance direction) abuts on a stopper 805 moved to a predetermined position depending on a size of the sheet (length in the sheet conveyance direction). A stopper movement sensor S2 (not illustrated) detects a position of the stopper 805. Upon receiving a drive of a stopper movement motor M2, the stopper 805 moves in the sheet conveyance direction along a sheet guide surface of a storage guide 803. Further, the end-portion stopper 805 includes a restriction surface 805*a* thrusting from the storage guide 803. The restriction surface 805*a* receives and retains the end portion of the sheet at the downstream side in the conveyance direction of the sheet conveyed to the storage guide 803.

A stapler 820 is provided at a position where a driver 820*a* and an anvil 820*b* are opposed to each other sandwiching the storage guide 803 therebetween. The stapler 820 functions as a stitching unit that stitches a center portion of the sheet bundle in the conveyance direction including a plurality of sheets stored in the storage guide 803. The stapler 820 is separated into the driver 820*a* for thrusting a needle and the anvil 820*b* for folding the thrust needle. When all sheets included in the sheet bundle is completed to be stored, the stapler 820 stitches the center portion of the sheet bundle in the conveyance direction with the needle.

At the downstream side of the stapler 820, a folding roller pair 810 and a thrust member 830 are provided to oppose to each other sandwiching the storage guide 803 therebetween. The folding roller pair 810 and the thrust member 830 function as a folding unit that double the sheet bundle stored in the storage guide 803 at the center portion of the sheet bundle in the conveyance direction. The thrust member 830 moves to the center portion of the sheet bundle stored in the storage guide 803 in the conveyance direction by a drive of a thrust motor M3 (not illustrated). The thrust member 830 has a home position disposed away from the storage guide 803, and a thrust sensor S3 (not illustrated) detects the home position. Further, a rotation amount of the thrust motor M3 is detected by an encoder sensor S5 included in a motor M3 (not illustrated). Based on an output of the encoder sensor S5, a moving amount of the thrust member 830 is detected. The center portion of the sheet bundle is pressed into a nip of the folding roller pair 810 by the thrust member 830 to fold the sheet bundle in the middle.

The sheet bundle folded in the middle by the folding roller pair 810 is further conveyed by a first fold conveyance roller pair 811 and a second fold conveyance roller pair 812, and stops after a leading end portion (folding line) of the sheet bundle folded in the middle is conveyed up to a press unit 860. Press roller pairs 861, 863 serving as first and second pressing members nip the folding line of the sheet bundle (booklet) stopped, and move along the folding line of the booklet while adding pressure to the folding line to perform a fold strengthening operation of the folding line (reinforcing the folding line).

After the press unit 860 performs the fold reinforcing operation, the booklet is conveyed in the downstream direction again and discharged onto a discharge tray 842. The discharge tray 842 includes a conveyer that is rotated and moved by a discharge tray motor M7 (not illustrated), and the booklet is conveyed by the conveyer to the downstream side of the discharge tray 842. The booklet is conveyed until being detected by a tray sensor S7 (not illustrated) provided on the discharge tray 842, and stacked thereon. The folding roller pair 810, the first fold conveyance roller pair 811, and the second fold conveyance roller pair 812 are driven by a fold conveyance motor M4 (not illustrated). A rotation speed of the fold conveyance motor M4 is monitored by a fold conveyance sensor S4 provided on a rotation axis of the fold conveyance motor M4 and the fold conveyance motor M4 is controlled to be rotated in constant speed. The fold conveyance sensor S4 detects a rotation amount of the motor, and detects a pulse generated from an optical encoder provided on the rotation axis to detect the rotation amount and rotation speed of the motor.

A stop position of the booklet when the fold reinforcing operation is performed is controlled based on a count value of the pulse from the fold conveyance sensor S4 after the bundle discharge sensor S8 detects the leading end of the booklet.

Figure 3:
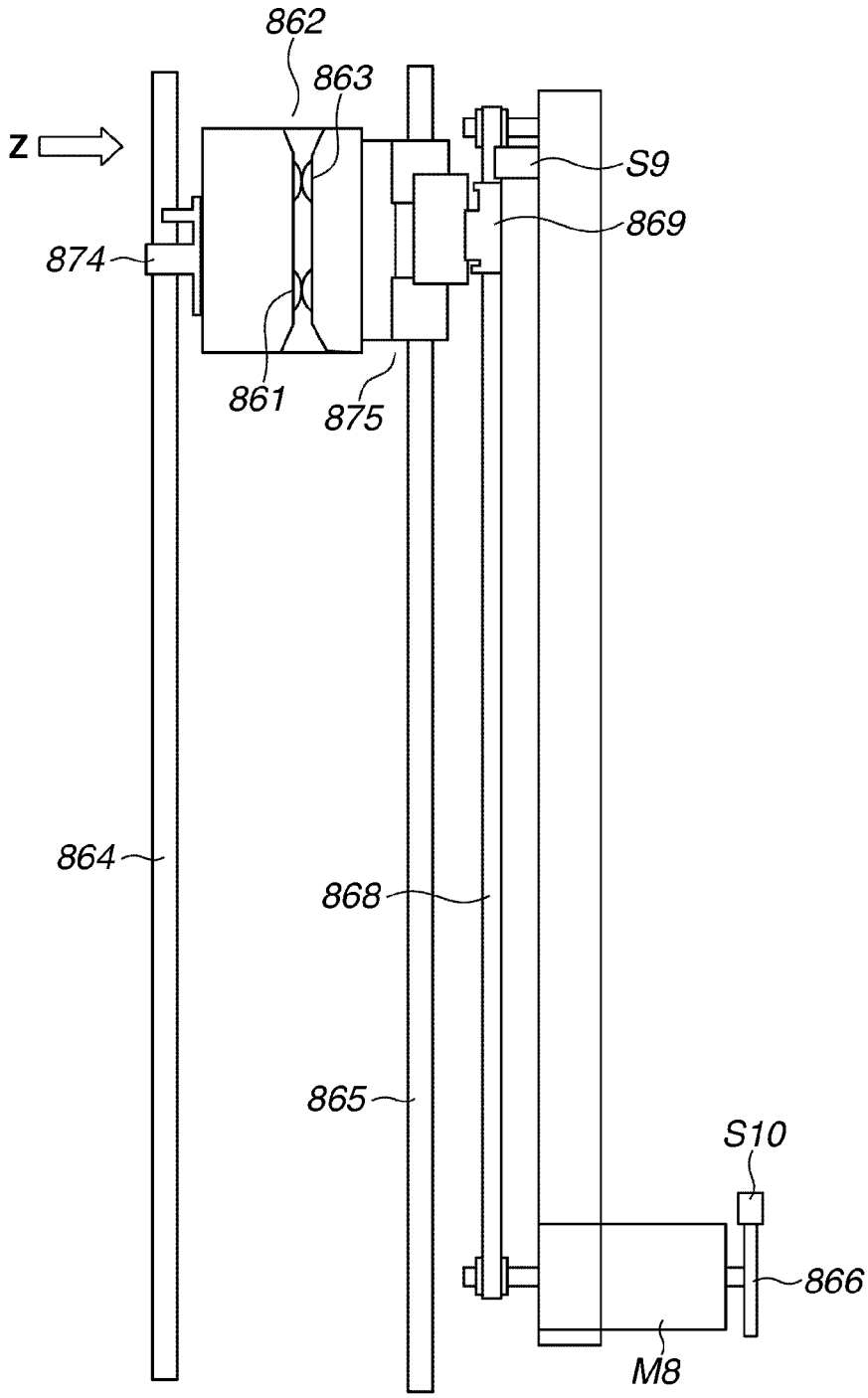
FIG. 3 illustrates a configuration of a press unit.

A configuration of the press unit 860 will be described. FIG. 3 is a diagram illustrating the press unit 860 viewed from an upper stream side in the conveyance direction. The press unit 860 is disposed at the downstream side of the second fold conveyance roller pair 812 and includes the press roller pairs 861, 863. FIG. 3 illustrates a state where a part of the press roller pairs 861, 863 can be viewed. The press roller pairs 861, 863 are supported by a press holder 862. The press holder 862 is supported by slide shafts 864, 865 through bearings 874, 875 respectively, and functions as a pressing member moving body for integrally moving the press roller pairs 861, 863. A timing belt 868 is fixed to the press holder 862 through a connection plate 869, and moved by a driving of a press motor M8. With this configuration, the press holder 862 acquires a rotation output of the press motor M8 and moves back and forth in a sheet-width direction. The press holder 862 is moved, and thus the sheet bundle is held by at least one of the press roller pairs 861, 863, thereby pressing the folding line of the sheet bundle.

A home sensor S9 detects a reference position, which is a home position of the press holder 862. The home position is disposed at the rear side (rear side on a paper surface in FIG. 2) when the sheet post-processing apparatus is viewed from the front. A clock (CLK) sensor S10 optically detects a slit of a rotary encoder 866 to detect a rotation amount of the press motor M8. With reference to timing with which the home sensor S9 detects the press holder 862, based on the rotation amount of the press motor M8 detected by the CLK sensor S10, a stop position of the press holder 862 is controlled.

Figure 4:
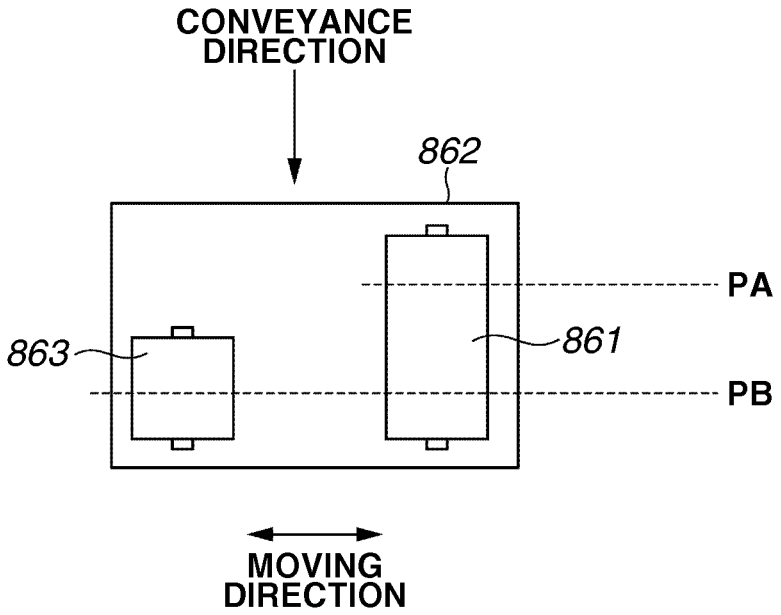
FIG. 4 is a top plan view of a press roller pair.

FIG. 4 illustrates a configuration of the press unit 860 viewed from a "Z" direction illustrated in FIG. 3. To press the folding line of the booklet, the press roller pair 861 presses the folding line as moving behind the press roller pair 863 which presses the folding line as moving. Further, the press roller pairs 861, 863 are disposed such that positions of the end portions thereof are different from each other at the upper stream side in an orthogonal direction of the folding line, in other words, in the sheet conveyance direction. Therefore, when the booklet stops at a position PA, the press roller pair 861 covers the folding line of the booklet while the press roller pair 863 does not cover the booklet. When the booklet stops at a position PB, both of the press roller pairs 861, 863 cover the folding line of the booklet. As described above, by setting the stop positions of the booklet to the different positions depending on the number of the sheets included in the booklet, the number of the press roller pairs abutting on the sheet bundle can be changed. Therefore, even when the folding line needs to be reinforced harder, compared with a case where the folding line is repeatedly pressed by one press roller pair, the time necessary for reinforcing the folding line can be decreased.

Figure 5:
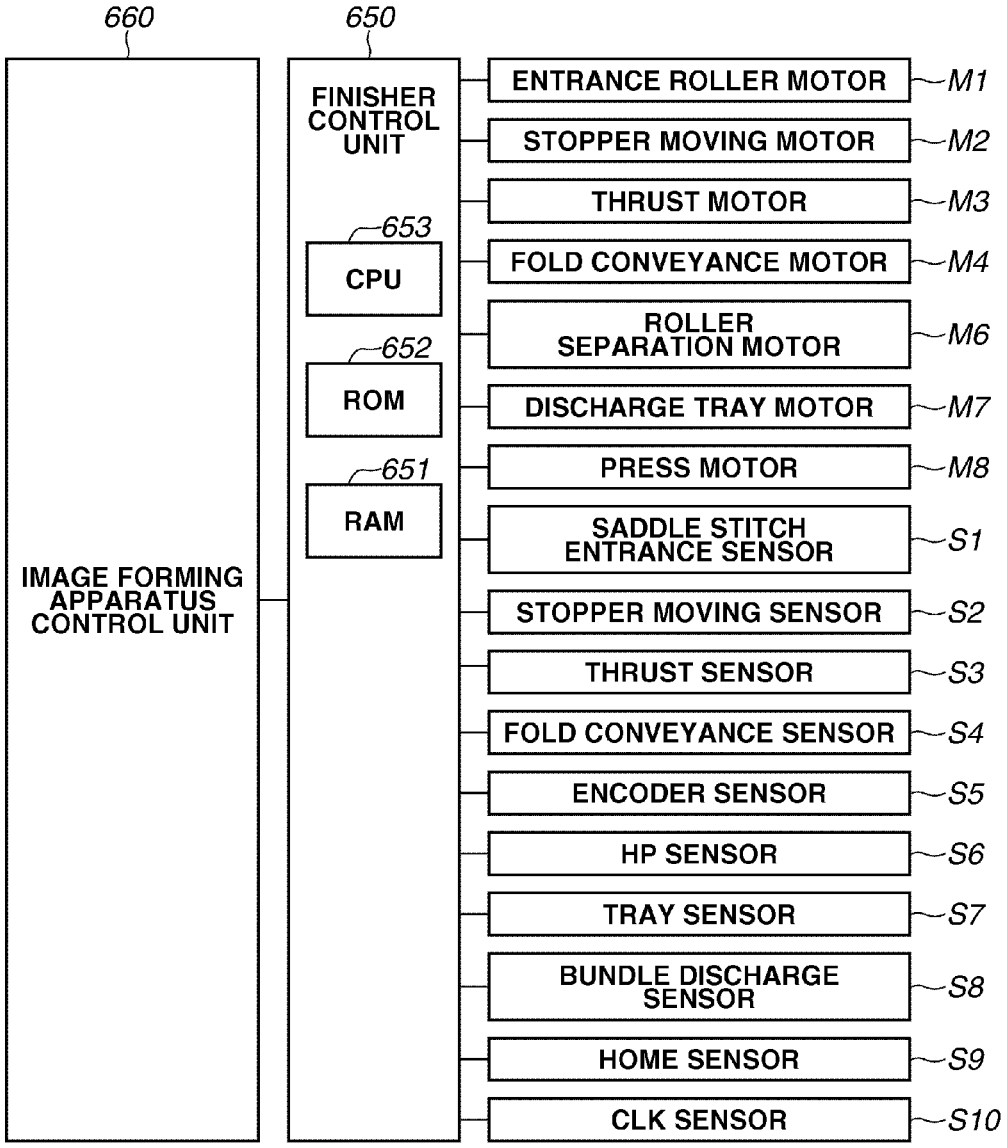
FIG. 5 is a control block diagram of the image forming apparatus and the sheet processing apparatus.

FIG. 5 illustrates a control block diagram of the image forming system. A finisher control unit 650 is, for example, mounted in the finisher 500, communicates with an image forming apparatus control unit 660, and controls the finisher 500 based on an instruction from an image forming apparatus control unit 660. A central processing unit (CPU) 653 of the finisher control unit 650 performs control based on a program stored in a read only memory (ROM) 652. A random access memory (RAM) 651 functions as a work area of the CPU 653. The finisher control unit 650 is connected with various types of motors and sensors as illustrated in FIG. 5.

A control operation will be described. With reference to a flowchart illustrated in FIG. 6, an operation of binding processing will be described. This flowchart is executed by the CPU 653 of the finisher control unit 650. In step S101, the CPU 653 checks the number of sheets included in the booklet. When the booklet includes a predetermined number of the sheets or less (five or less), in step S103, the CPU 653 moves the press holder 862 to a waiting position "A" for starting pressing, and sets the position for stopping the booklet to a position PA (illustrated in FIG. 4). The number of sheets included in the booklet is informed from the image forming apparatus control unit 660 to the finisher control unit 650. When the number of sheets is six or more, in step S102, the CPU 653 moves the press holder 862 to a waiting position "B" for starting pressing, and sets the position for stopping the booklet to a position PB (illustrated in FIG. 4). As illustrated in FIG. 7A, the waiting position "A" is a position where, with the booklet stopped at the position PA, the press roller pair 861 approaches a side edge of the booklet by a predetermined small distance (e.g., 1 cm). On the other hand, as illustrated in FIG. 7B, the waiting position "B" is a position where, with the booklet stopped at the position PB, the press roller pair 863 approaches a side end of the booklet by the predetermined small distance.

The waiting positions "A", "B" are disposed at the front side when the sheet post-processing apparatus is viewed from the front. When the booklet includes a comparatively small number of sheets, pressing only by one press roller pair can sufficiently reinforce the folding line. Thus, if the press holder 862 is set to wait at the waiting position "A" so that the press roller pair 861 approaches the side edge of the booklet, the moving distance up to a movement finish position of the press holder 862 becomes shorter, thereby decreasing the time necessary for a folding-line pressing operation. For example, when a shift amount between the waiting position "A and the waiting position "B" is 100 mm and a moving speed of the press holder 862 is 200 mm/s, compared with a case where the press roller pair 861 starts the pressing operation at the waiting position "B", a processing time can be decreased by 500 ms. According to the present exemplary embodiment, the waiting position is changed according to whether the number of sheets included in the booklet is five or less, or six or more. However, the waiting position may be set for each device in consideration of a reinforcement state of the folding line and the productivity, and thus the values should not be limited to the above-described values.

In step S104, the CPU 653 stacks the sheets into the storage guide 803. In step S105, until all sheets included in the booklet are finished to be stacked, the CPU 653 repeatedly performs a sheet stacking operation. When all the sheet stacking operation is finished (YES in step S105), in step S106, the CPU 653 performs a staple operation. Subsequently, in step S107, the CPU 653 doubles the sheet bundle by the thrust member 830, and conveys the sheet bundle in a booklet-like shape to a position where the fold reinforcing operation is performed. In step S108, the CPU 653 waits the bundle discharge sensor S8 to be turned on. When the bundle discharge sensor S8 is turned on (YES in step S108), in step S109, the CPU 653 determines the number of sheets included in the booklet.

When the number of sheets is five or less, in step S111, the CPU 653 stops the booklet at the position PA where the booklet is conveyed A mm from the bundle discharge sensor S8. When the number of sheets is six or more, in step S110, the CPU 653 stops the booklet at the position PB where the booklet is conveyed B mm from the bundle discharge sensor S8. As illustrated in FIG. 7A, the position PA is a stop position where only the press roller pair 861 abuts on the folding line. On the other hand, as illustrated in FIG. 7B, the position PB is a stop position where the press roller pairs 861, 863 abut on the folding line. As described above, when the booklet includes a large number of sheets, the number of press roller pairs to be abutted is increased to reinforce the folding line of the booklet including the large number of sheets.

Subsequently, in step S112, the CPU 653 moves the press holder 862 from the waiting position "A" or "B" to the movement finish position to perform the fold reinforcing operation. In step S113, upon finishing the fold reinforcing operation, the CPU 653 discharges the booklet to the discharge tray 842. In step S114, the CPU 653 repeatedly performs the above-described operation until the booklet is finished to be discharged. When the final booklet is finished to be discharged (YES in step S114), in step S115, the CPU 653 moves the press holder 862 to the home position, and ends the processing.

Figure 7A:
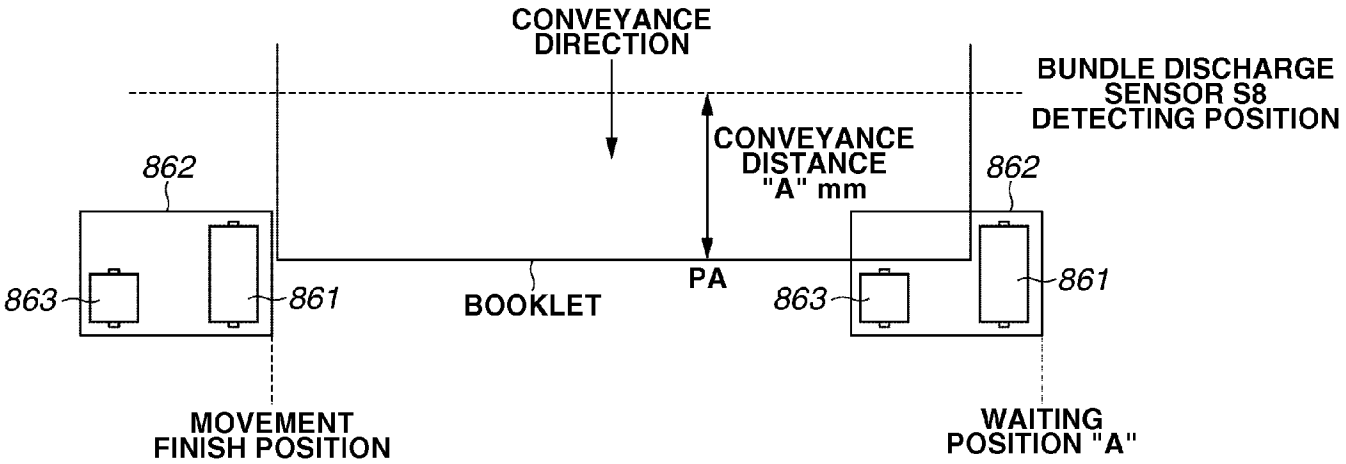
FIGS. 7A and 7B illustrate waiting positions of a press holder and stop positions of a booklet.
Figure 8:
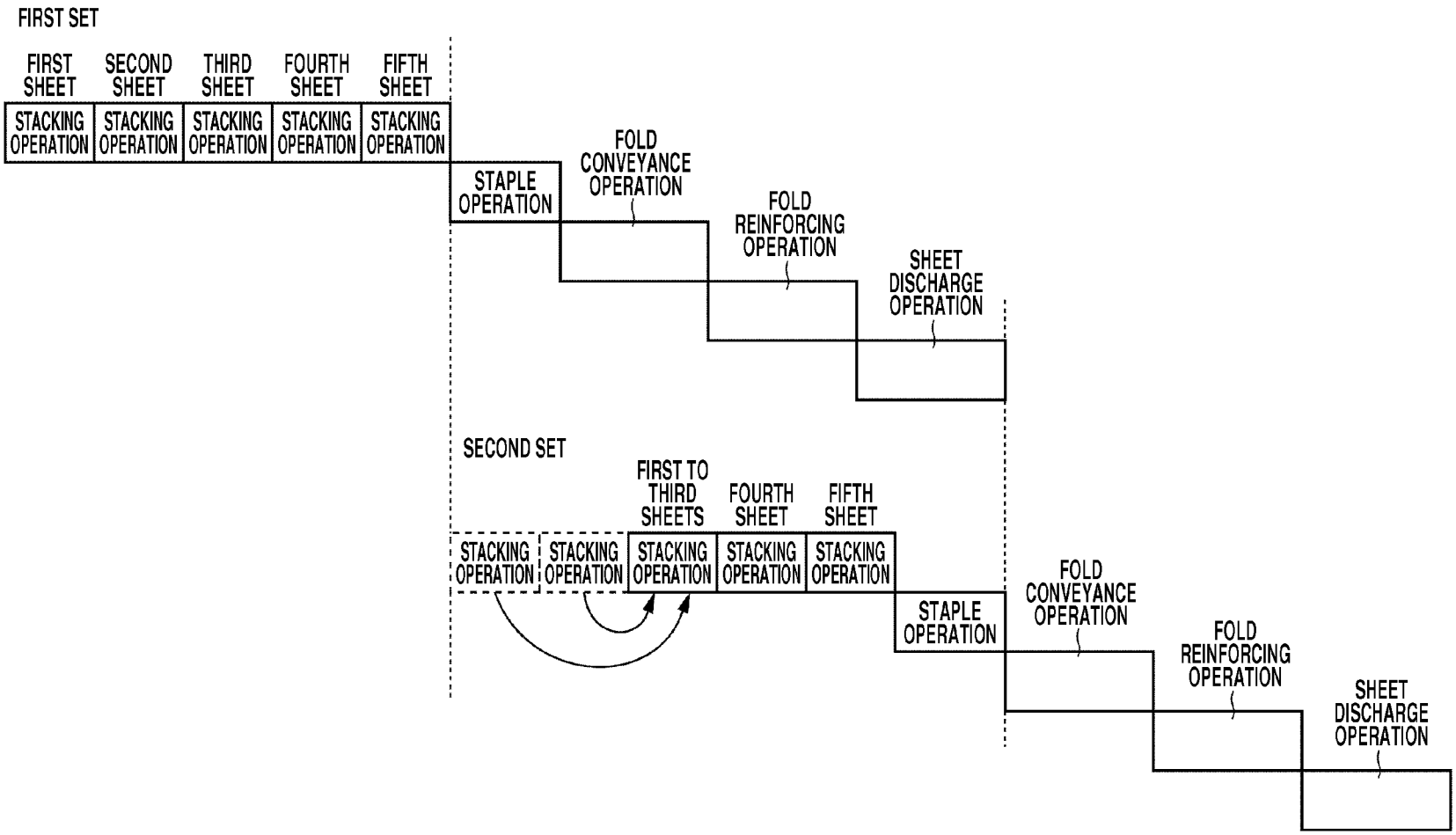
FIG. 8 is a timing chart for the binding processing.

A timing chart will be described. Timing for performing processing on each sheet of the booklet will be described. FIG. 8 is a timing chart when the press holder 862 is set to wait at the waiting position "A" (illustrated in FIG. 7A). From a first sheet to a fifth sheet of the booklet of a first set, the sheets are stacked in the storage guide 803 in sequence. The staple operation, fold conveyance operation, fold reinforcing operation, and sheet discharge operation are performed in sequence. When the booklet of the first set remains in the storage guide 803, a stack operation cannot be performed on the sets of the second set. Therefore, from when the staple operation for the first set is finished until when the fold conveyance operation is started, the first to third sheets of the second set are stacked in a buffer path 560 of the finisher 500, and set to wait. Since a configuration of the buffer path is a known technique, details will not be described herein. Subsequently, after the first sheet bundle has been conveyed from the storage guide 803, the first to third sheets of the second set that have been waiting in the buffer path are stacked in the storage guide 803 while being overlapped by each other. The following control is the same as that of the first set.

If the discharge operation of the booklet of the first set is finished by start timing for the fold conveyance operation of the sheet bundle of the second set, the productivity of the booklets is not lowered. However, if the booklet of the first set remains on the fold conveyance path, the fold conveyance operation cannot be performed on the sheet bundle of the second set. Thus, a longer interval for conveying the sheets is necessary.

Figure 9:
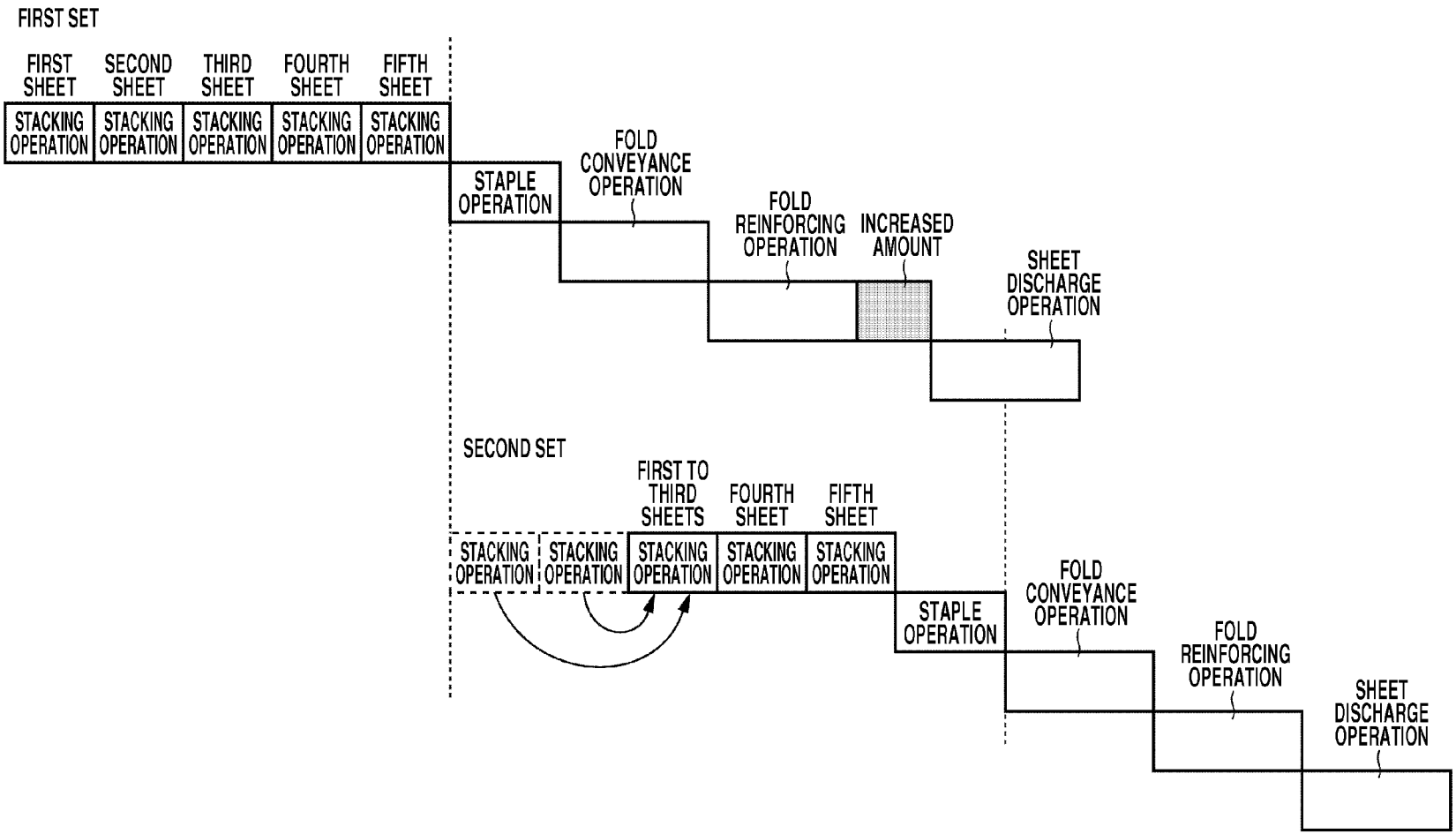
FIG. 9 is a timing chart for the binding processing.

FIG. 9 is a timing chart when the press holder 862 is set to wait at the waiting position "B" (illustrated in FIG. 7B). In FIG. 9, since a moving distance of the press holder 862 from the waiting position "B" to the movement finish position becomes longer, a time necessary for the fold reinforcing operation is increased by an amount of a shaded portion illustrated in FIG. 9. As a result, since the discharge operation of the first set is not finished by the start of the fold conveyance operation of the second set, the fold conveyance operation of the second set needs to wait to start, thereby lowering the productivity.

Therefore, according to the present exemplary embodiment, when the number of the sheets included in the booklet is five or less, since one press roller pair can sufficiently perform the folding process, the press holder 862 is set to wait at the waiting position "A". As described above, the plurality of press roller pairs are disposed in the direction along the folding line of the booklet. The positions of end portions in an axis direction of the plurality of press roller pairs are offset and disposed in the booklet conveyance direction. With such arrangements, depending on the stop position of the booklet, the number of the press roller pairs pressing the folding line can be changed. Thus, the folding line of the booklet can be reinforced without lowering the productivity of producing the booklets.

According to the first exemplary embodiment, two press roller pairs are used, however, three or more press roller pairs may be used. In such a case, the stop positions of the booklet and the waiting position of the press holder 862 are set according to the number of the press roller pairs.

Figure 11A:
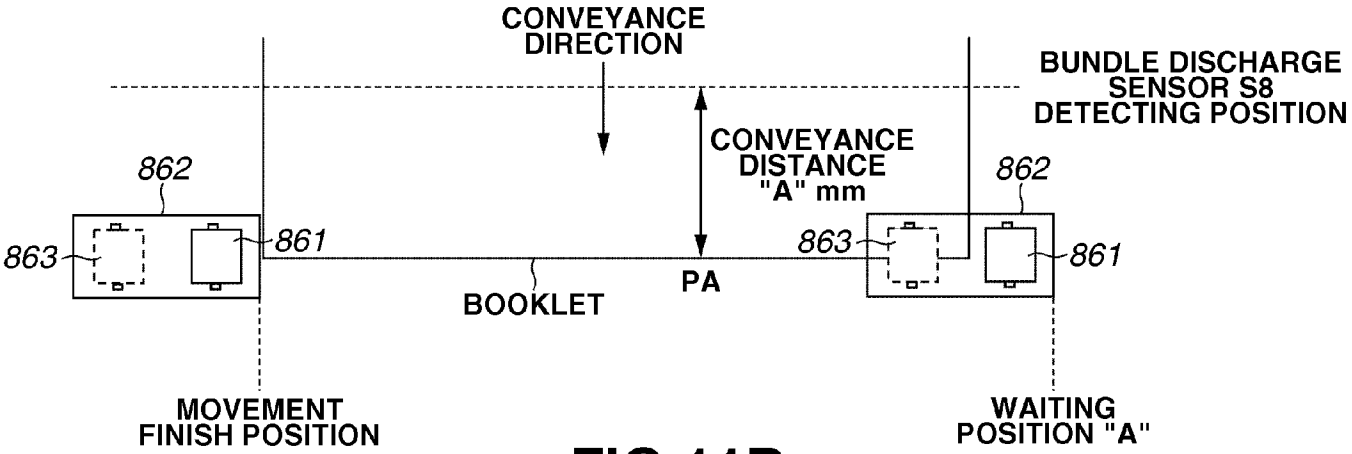
FIGS. 11A and 11B illustrate waiting positions of a press holder according to the second exemplary embodiment.
Figure 11B:
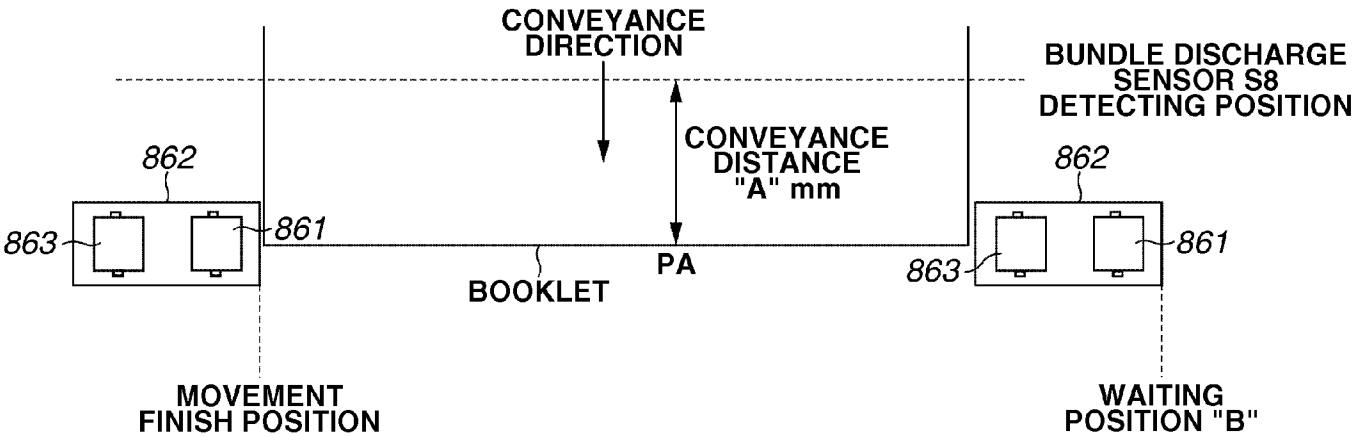

A second exemplary embodiment will be described. According to the second exemplary embodiment, the press roller pair is separated from each other to change the number of the press roller pairs pressing the folding line of the booklet As illustrated in FIGS. 11A, 11B, unlike the first exemplary embodiment, the stop position of the booklet does not need to vary according to the number of the sheets included in the booklet. Neither need to vary the positions of the end portions of the plurality of press roller pairs. According to the present exemplary embodiment, the press roller pair 863 is configured to be capable of separated from each other, however the press roller pair 861 does not need to be configured to be capable of separated. Further, since the positions of the press roller pairs 861, 863 in the booklet conveyance direction do not need to be shifted from each other, a length of the press roller pair 861 is shorter than that of the first exemplary embodiment.

Figure 10:
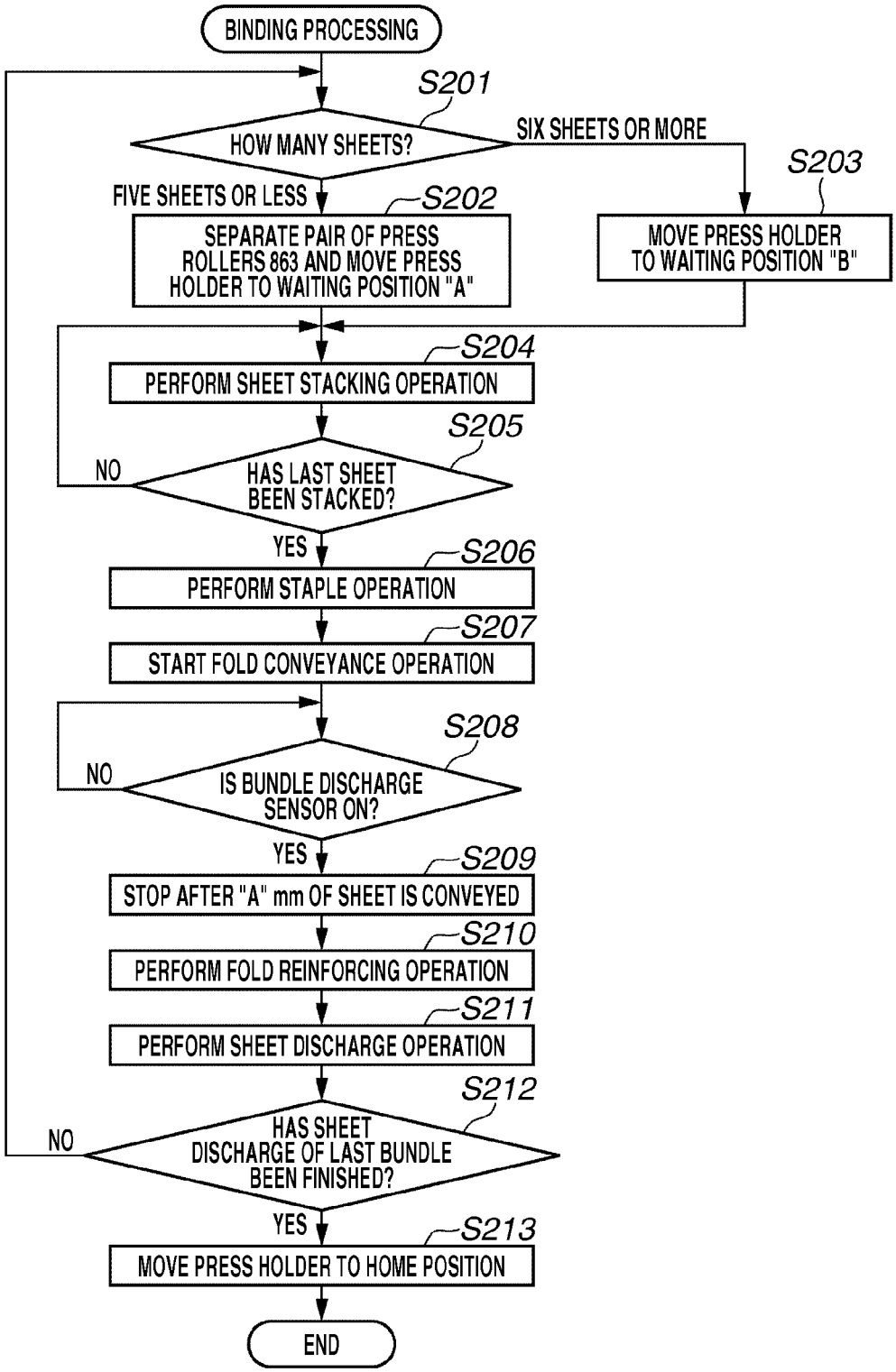
FIG. 10 is a flowchart illustrating the binding processing according to a second exemplary embodiment.

With reference to the flowchart illustrated in FIG. 10, an operation according to the second exemplary embodiment will be described herebelow. Processing of the flowchart illustrated in FIG. 10 is executed by the CPU 653 of the finisher control unit 650.

In step S201, the CPU 653 checks the number of the sheets included in the booklet. When the number of the sheets in the booklet is five or less, in step S202, the CPU 653 sets the press roller pair 863 to be separated from each other, and moves the press holder 862 to the waiting position "A". On the other hand, when the number of the sheets included in the booklet is six or more, in step S203, the CPU 653 sets the press roller pair 863 not to be separated from each other, and moves the press holder 862 to the waiting position "B". For the booklet including five or less sheets, the CPU 653 sets the press roller pair 863 to be separated from each other as illustrated in FIG. 11A so that the press roller pair 863 is not in contact with the folding line of the booklet and the press holder 862 (press roller pair 861) can approach the side edge of the booklet. In FIG. 11A, the separated press roller pair 863 is illustrated with a broken line. A separation motor (not illustrated) separates the press roller pair 863 from each other. On the other hand, for the booklet including six or more sheets, the CPU 653 does not set the press roller pair 863 to be separated from each other as illustrated in FIG. 11B, but sets to wait at the waiting position "B".

Figure 6:
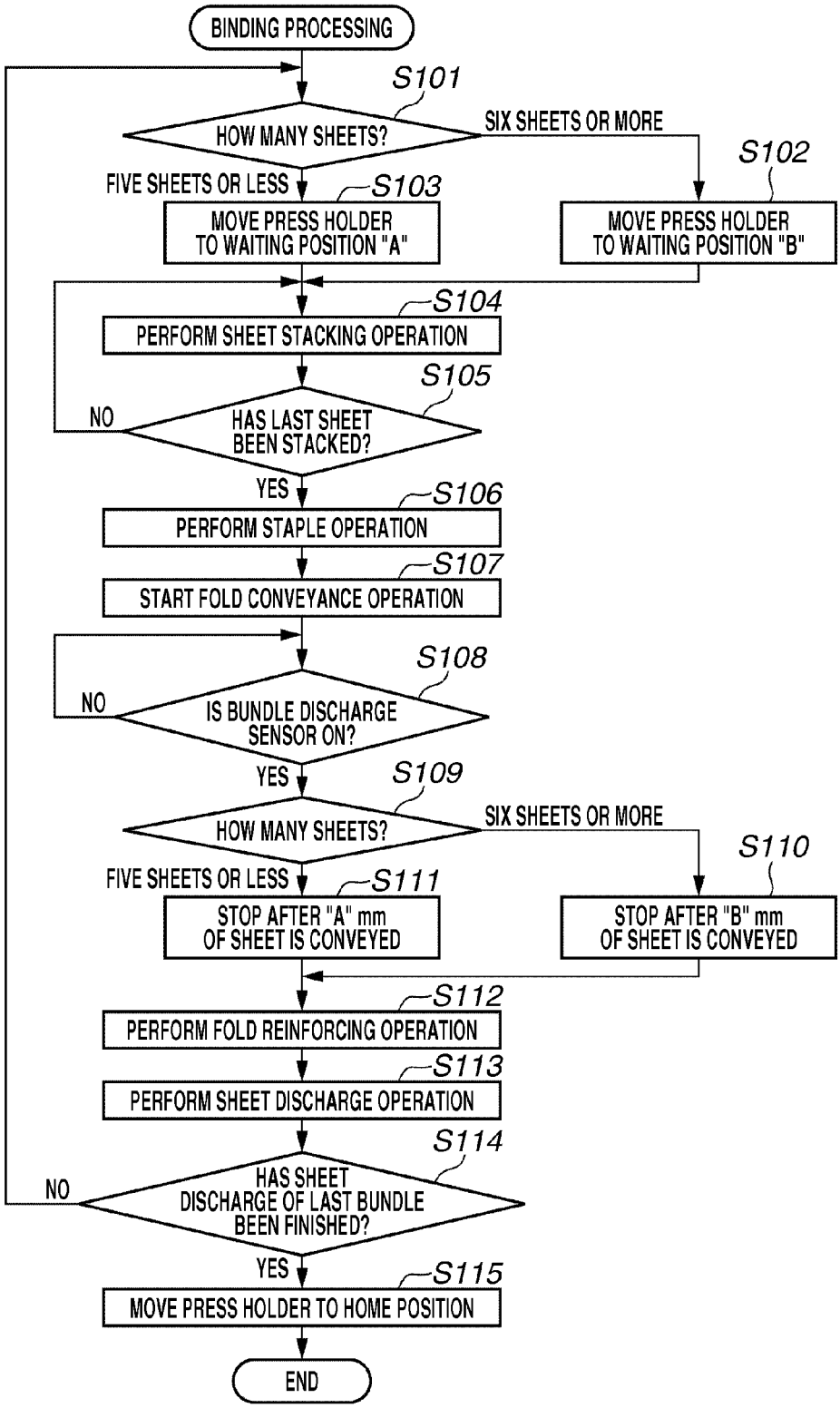
FIG. 6 is a flowchart illustrating binding processing.
Figure 7B:
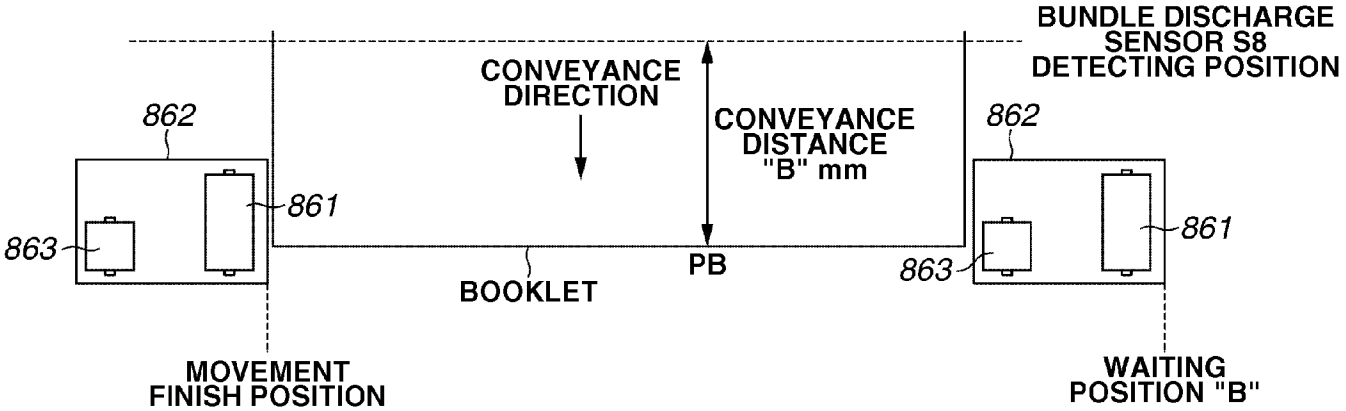

Processing of steps S204 to S208 is same as that of steps S104 to S108 illustrated in FIG. 6, and thus the descriptions will not be repeated. In step S208, when the bundle discharge sensor S8 is turned on by detecting the booklet, in step S209, the CPU 653 further conveys the booklet by A mm and stops it at the position PA. In step S210, the CPU 653 moves the press holder 862 stopped at the waiting position "A" or "B" to the movement finish position to perform the fold reinforcing processing on the folding line of the booklet. When the press holder 862 moves to the movement finish position (when the fold reinforcing processing is finished), in step S211, the CPU 653 performs a booklet discharge operation. The following processing (steps S212, S213) is similar to that of steps S114, S115 illustrated in FIG. 6.

According to the second exemplary embodiment, since the positions of the plurality of press roller pairs in the booklet conveyance direction do not need to vary, a width of the press holder 862 in the booklet conveyance direction can be reduced, thereby making the apparatus more compact. Further, as with the first exemplary embodiment, when the booklet includes the small number of the sheets, the press roller pair 863 closer to the booklet is separated from each other and change the position of the press holder 862 to reduce the time necessary for performing the fold reinforcing processing.

When the number of the sheets is five or less, after the press holder 862 is started to move, separation of the press roller pair 863 separated from each other may be canceled to press the folding line. In such a case, one portion is pressed by two press roller pairs and other portion is pressed by one press roller pair, however, only a small number of the sheets are originally included, and thus difference in the folding line is not outstanding.

According to the first and second exemplary embodiments, the waiting position of the press holder 862 varies according to the number of the sheets included in the booklet. As another method, from information about a thickness of the sheet conveyed from the image forming apparatus and the number of the sheets, the thickness of the booklet is calculated. With the calculated thickness, the waiting position of the press holder 862 may be changed. In such a case, the CPU 653 performs control so that the waiting position "A" closer to the booklet is set for the booklet having a smaller thickness.

Further, according to the first and second exemplary embodiments, the press roller pairs 861, 863 are integrally moved. However, the press roller pair 861 is moved independently from the press roller pair 863. In such a case, when the number of the sheets included in the booklet is the predetermined number or less, the press roller pair 861 waits at the waiting position "A" with the press roller pair 863 remained at the home position, and then the press roller pair 861 is moved while pressing the folding line of the sheet bundle. Further, when the number of the sheets is more than the predetermined number, the press roller pairs 861, 863 wait at the waiting position "B". Subsequently, the press roller pairs 861, 863 are moved while pressing the folding line.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-068004 filed Mar. 25, 2011, which is hereby incorporated by reference herein in its entirety.

What is claimed is:

1. A sheet post-processing apparatus comprising:

a folding unit configured to fold a sheet bundle including a plurality of sheets;

a fold reinforcing unit configured to reinforce fold by pressing a folding line of the sheet bundle folded by the folding unit, the fold reinforcing unit comprising first and second pressing members moving along the folding line while pressing the folding line, the first pressing member moving while pressing the folding line behind the second pressing member which move while pressing the folding line; and a control unit configured, when a number of the plurality of sheets included in the sheet bundle is a predetermined number or less, to control the fold reinforcing unit so that the first pressing member presses the folding line and the second pressing member does not press the folding line, and configured, when the number of the plurality of sheets included in the sheet bundle is more than the predetermined number, to control the fold reinforcing unit so that both of the first and second pressing members press the folding line.

2. The sheet post-processing apparatus according to claim 1, wherein the first and second pressing members are roller pairs each nipping the folding line.

3. The sheet post-processing apparatus according to claim 1, wherein a position of the second pressing member is different from a position of the first pressing member in a direction orthogonal to a direction along the folding line.

4. The sheet post-processing apparatus according to claim 3, further comprising a conveyance unit configured to convey the sheet bundle to the fold reinforcing unit, wherein the control unit is configured, when the number of the plurality of sheets included in the sheet bundle is the predetermined number or less, to control the conveyance unit so that the sheet bundle is stopped at a position where the first pressing member does not press the folding line of the sheet bundle and the second pressing members press the folding line of the sheet bundle, and is configured, when the number of the plurality of sheets included in the sheet bundle is more than the predetermined number, to control to the conveyance unit so that the sheet bundle is stopped at a position where both the first and second pressing members press the folding line of the sheet bundle.

5. The sheet post-processing apparatus according to claim 4, wherein the fold reinforcing unit includes a pressing-member moving body that integrally moves the first and second pressing members, and wherein the control unit is configured to vary a waiting position where the pressing-member moving body starts pressing so that the first pressing member becomes closer to a side edge of the sheet bundle when the number of the plurality of sheets included in the sheet bundle is less than the predetermined number rather than when the number of the plurality of sheets included in the sheet bundle is more than the predetermined number.

6. The sheet post-processing apparatus according to claim 3, wherein a position of an end portion of the second pressing member is different from a position of an end portion of the first pressing member in the direction orthogonal to the direction along the folding line.

7. The sheet post-processing apparatus according to claim 1, wherein the second pressing member comprises a roller pair that is capable of separating from each other and press the folding line, and, when the number of the plurality of sheets included in the sheet bundle is a predetermined number or less, the roller pair are separated from each other.

8. The sheet post-processing apparatus according to claim 7, wherein the control unit is configured to vary a waiting position of the first pressing member so that the waiting position where the first pressing member starts pressing when the number of the plurality of sheets included in the sheet bundle is the predetermined number or less becomes closer to the side edge of the sheet bundle than the waiting position where the first pressing member starts pressing when the number of the plurality of sheets included in the sheet bundle is more than the predetermined number.

9. The sheet post-processing apparatus according to claim 8, further comprising a conveyance unit configured to convey the sheet bundle to the fold reinforcing unit, wherein, the control unit is configured, when the number of the plurality of sheets included in the sheet bundle is the predetermined number or less, to set the roller pair, which are separated from each other, to wait at the waiting position the sheet bundle to be conveyed to the fold reinforcing unit by the conveyance unit.

10. The sheet post-processing apparatus according to claim 1, wherein the fold reinforcing unit comprises a pressing-member moving body that integrally moves the first and second pressing members.

11. A sheet post-processing apparatus comprising:

a folding unit configured to fold a sheet bundle including a plurality of sheets;

a fold reinforcing unit configured to reinforce fold by pressing a folding line of the sheet bundle folded by the folding unit, the fold reinforcing unit comprising first and second pressing members moving along the folding line while pressing the folding line, the first pressing member moving while pressing the folding line behind the second pressing member which move while pressing the folding line; and a control unit configured, when a thickness of the sheet bundle is a predetermined thickness or less, to control the fold reinforcing unit so that the first pressing member presses the folding line but the second pressing member does not press the folding line, and configured, when the thickness thereof is more than the predetermined thickness, to control the fold reinforcing unit so that both the first and second pressing members press the folding line.

12. The sheet post-processing apparatus according to claim 11, wherein the first and second pressing members are roller pairs each nipping the folding line.

13. The sheet post-processing apparatus according to claim 11, wherein a position of the second pressing member is different from a position of the first pressing member in a direction orthogonal to a direction along the folding line.

14. The sheet post-processing apparatus according to claim 13, further comprising a conveyance unit configured to convey the sheet bundle to the fold reinforcing unit, wherein the control unit is configured, when the thickness of the sheet bundle is the predetermined thickness or less, to control the conveyance unit so that the sheet bundle is stopped at a position where the first pressing member does not press the folding line of the sheet bundle and the second pressing members press the folding line of the sheet bundle, and is configured, when the thickness of the sheet bundle is more than the predetermined thickness, to control to the conveyance unit so that the sheet bundle is stopped at a position where both the first and second pressing members press the folding line of the sheet bundle.

15. The sheet post-processing apparatus according to claim 14, wherein the fold reinforcing unit includes a pressing-member moving body that integrally moves the first and second pressing members, and wherein the control unit is configured to vary a waiting position where the pressing-member moving body starts pressing so that the first pressing member becomes closer to a side edge of the sheet bundle when the thickness of the sheet bundle is less than the predetermined thickness rather than when the thickness of the sheet bundle is more than the predetermined thickness.

16. The sheet post-processing apparatus according to claim 13, wherein a position of an end portion of the second pressing member is different from a position of an end portion of the first pressing member in the direction orthogonal to the direction along the folding line.

17. The sheet post-processing apparatus according to claim 11, wherein the second pressing member comprises a roller pair that is capable of separating from each other and press the folding line, and, when the thickness of the sheet bundle is a predetermined thickness or less, the roller pair are separated from each other.

18. The sheet post-processing apparatus according to claim 17, wherein the control unit is configured to vary a waiting position of the first pressing member so that the waiting position where the first pressing member starts pressing when the thickness of the sheet bundle is the predetermined thickness or less becomes closer to the side edge of the sheet bundle than the waiting position where the first pressing member starts pressing when the thickness of the sheet bundle is more than the predetermined thickness.

19. The sheet post-processing apparatus according to claim 18, further comprising a conveyance unit configured to convey the sheet bundle to the fold reinforcing unit, wherein, the control unit is configured, when the thickness of the sheet bundle is the predetermined thickness or less, to set the roller pair, which are separated from each other, to wait at the waiting position the sheet bundle to be conveyed to the fold reinforcing unit by the conveyance unit.

20. The sheet post-processing apparatus according to claim 11, wherein the fold reinforcing unit comprises a pressing-member moving body that integrally moves the first and second pressing members.

* * * * *